US010201836B2

(12) United States Patent
Jikihara et al.

(10) Patent No.: US 10,201,836 B2
(45) Date of Patent: Feb. 12, 2019

(54) POWDER CLASSIFYING APPARATUS

(71) Applicant: NISSHIN SEIFUN GROUP INC., Tokyo (JP)

(72) Inventors: Kenji Jikihara, Fujimino (JP); Masaru Kyugo, Fujimino (JP); Akihiko Ema, Fujimino (JP); Hiroomi Uehara, Fujimino (JP)

(73) Assignee: Nisshin Seifun Group Inc., Tokyo (JP)

( * ) Notice: Subject to any disclaimer, the term of this patent is extended or adjusted under 35 U.S.C. 154(b) by 0 days.

(21) Appl. No.: 15/544,194

(22) PCT Filed: Jan. 8, 2016

(86) PCT No.: PCT/JP2016/050521
§ 371 (c)(1),
(2) Date: Jul. 17, 2017

(87) PCT Pub. No.: WO2016/114234
PCT Pub. Date: Jul. 21, 2016

(65) Prior Publication Data

US 2018/0009004 A1 Jan. 11, 2018

(30) Foreign Application Priority Data

Jan. 16, 2015 (JP) ..... 2015-007113

(51) Int. Cl.
*B07B 7/086* (2006.01)
*B07B 7/08* (2006.01)
*B07B 4/02* (2006.01)

(52) U.S. Cl.
CPC ..... *B07B 7/08* (2013.01); *B07B 4/02* (2013.01); *B07B 7/086* (2013.01)

(58) Field of Classification Search
CPC ..... B07B 7/08; B07B 7/083; B07B 7/086; B07B 7/10; B07B 11/02; B07B 11/06
See application file for complete search history.

(56) References Cited

U.S. PATENT DOCUMENTS 2,616,563 A * 11/1952 Hebb ..... B04C 1/00 209/135
3,048,271 A * 8/1962 Sharples ..... B07B 7/08 209/135

(Continued)

FOREIGN PATENT DOCUMENTS

JP 4785802 B2 10/2011
WO WO-2007145207 A1 * 12/2007 ..... B07B 7/086

*Primary Examiner* — Joseph C Rodriguez
(74) *Attorney, Agent, or Firm* — Muncy, Geissler, Olds & Lowe, P.C.

(57) ABSTRACT

The powder classifying apparatus classifies raw material powder having a particle size distribution into fine powder and coarse powder and includes a disk-like centrifuge chamber formed as a space between two facing members, a plurality of air nozzles for supplying gas into the centrifuge chamber to generate a whirling stream, a raw material ejecting nozzle for supplying the raw material powder to the whirling stream generated in the centrifuge chamber, a fine powder collecting tube disposed in a central portion of one of the two facing members and communicating with the centrifuge chamber to discharge the gas including the fine powder separated in the centrifuge chamber to the outside, a cylindrical first wall disposed at an opening portion formed of the fine powder collecting tube, and a cylindrical second wall disposed on the other one of the two facing members and facing the first wall with a given interval.

17 Claims, 5 Drawing Sheets

(56) References Cited

U.S. PATENT DOCUMENTS

| | | | | |
|---|---|---|---|---|
| 4,793,917 | A * | 12/1988 | Eremin | B07B 7/083 209/143 |
| 5,931,305 | A * | 8/1999 | Akiyama | B07B 7/083 209/139.2 |
| 6,276,534 | B1 * | 8/2001 | Huang | B07B 7/083 209/139.2 |
| 8,668,090 | B2 * | 3/2014 | Taketomi | B07B 4/02 209/135 |
| 8,925,398 | B2 * | 1/2015 | Kozawa | B07B 4/00 73/28.04 |
| 9,050,630 | B2 * | 6/2015 | Kozawa | B07B 4/08 |
| 9,415,421 | B2 * | 8/2016 | Kozawa | B07B 7/08 |
| 9,597,712 | B2 * | 3/2017 | Kozawa | B07B 7/086 |
| 2009/0032443 | A1 | 2/2009 | Taketomi et al. | |
| 2011/0219854 | A1 * | 9/2011 | Kozawa | B07B 4/00 73/25.05 |

* cited by examiner

POWDER CLASSIFYING APPARATUS

TECHNICAL FIELD

The present invention relates to a powder classifying apparatus that classifies raw material powder having a particle size distribution into fine powder and coarse powder at a desired particle size (classification point) using a balance between a centrifugal force imparted to the powder by a whirling stream of gas and a drag.

BACKGROUND ART

At present, nanoparticles such as oxide nanoparticles, nitride nanoparticles and carbide nanoparticles are used in the production of semiconductor substrates, printed circuit boards, electrical insulation materials for various electrical insulation parts and the like, cutting tools, dies, bearings and other high-hardness and high-precision machining tool materials, functional materials for humidity sensors and the like, and sintered bodies for use as precision sinter molding materials, and in the production of thermal sprayed parts such as engine valves made of materials that are required to be wear-resistant at a high temperature, as well as in the fields of electrode or electrolyte materials and various catalysts for fuel cells. The use of those nanoparticles improves bonding strength between different ceramics or different metals and denseness as well as functionalities of sintered bodies, thermal sprayed parts and the like.

The above-described nanoparticles are produced by a chemical approach in which various gases or the like are chemically reacted at high temperature or a physical approach in which substances are irradiated with an electron beam, laser beam or the like to be decomposed and vaporized, thereby generating nanoparticles. The nanoparticles produced by the above approaches have a particle size distribution and contain coarse powder and fine powder mixed together. The nanoparticles used in the applications described above preferably has a smaller proportion of coarse powder, since excellent properties can be achieved. Accordingly, a powder classifying apparatus that uses a whirling stream to impart whirling motion to powder such that the powder is centrifuged into coarse powder and fine powder has been utilized (see Patent Literature 1 , for example).

Patent Literature 1 describes a powder classifying apparatus in which powder having a particle size distribution is carried by an air stream and supplied. The powder classifying apparatus of Patent Literature 1 includes a hollow cavity in a disc-like shape (disc-like cavity portion) in which the supplied powder having a particle size distribution is classified, a powder supply port for supplying the powder having a particle size distribution to the disc-like cavity portion, a plurality of guide vanes arranged so as to each extend from an outer circumference of the disc-like cavity portion in an inward direction at a given angle, a discharge unit for an air stream including fine powder discharged from the disc-like cavity portion, a collection unit for coarse powder discharged from the disc-like cavity portion, and a plurality of air nozzles arranged on an outer circumferential wall of the disc-like cavity portion along a tangential direction of the outer circumferential wall below the guide vanes and blowing compressed air toward the collection unit for coarse powder inside the disc-like cavity portion to bring fine powder present near the collection unit for coarse powder back to the disc-like cavity portion.

CITATION LIST

Patent Literature

Patent Literature 1: JP 4785802 B

SUMMARY OF INVENTION

Technical Problems

While the powder classifying apparatus of Patent Literature 1 can classify raw material powder having a particle size distribution into fine powder and coarse powder at a desired particle size (classification point), the demanded particle size of fine powder becomes smaller recently, and it is desirable that the classification point of a powder classifying apparatus is further lowered.

An object of the present invention is to solve the problem of the related art described above and to provide a powder classifying apparatus having a smaller classification point while maintaining classification accuracy when classifying raw material powder into fine powder and coarse powder.

Solution to Problems

In order to attain the above object, the present invention provides a powder classifying apparatus for classifying raw material powder having a particle size distribution into fine powder and coarse powder, comprising: a centrifuge chamber in a disk-like shape formed as a space between two facing members; a plurality of air nozzles for supplying gas into the centrifuge chamber to generate a whirling stream; a raw material ejecting nozzle for supplying the raw material powder to the whirling stream generated in the centrifuge chamber; a fine powder collecting tube disposed in a central portion of one of the two facing members, which define the centrifuge chamber, so as to communicate with an inside of the centrifuge chamber and to discharge the gas including the fine powder that is separated through classification in the centrifuge chamber to an outside of the centrifuge chamber; a coarse powder collecting section disposed at an outer peripheral portion of the centrifuge chamber so as to communicate with the inside of the centrifuge chamber and to discharge the coarse powder that is separated through classification in the centrifuge chamber to the outside of the centrifuge chamber; a first wall in a cylindrical shape disposed at an opening portion of the centrifuge chamber so as to project into the centrifuge chamber, the opening portion being formed of the fine powder collecting tube; and a second wall in a cylindrical shape disposed on the other one of the two facing members, which define the centrifuge chamber, so as to face the first wall with a given interval, wherein at least one of a part around the first wall of a surface portion of the one of the two facing members that define the space of the centrifuge chamber and a part around the second wall of a surface portion of the other one of the two facing members that define the space of the centrifuge chamber is formed of an inclined plane, the surface portions facing the centrifuge chamber.

Preferably, the part around the first wall of the surface portion of the one of the two facing members that define the space of the centrifuge chamber is formed of an inclined plane, while the part around the second wall of the surface portion of the other one of the two facing members that define the space of the centrifuge chamber is formed of an inclined plane, the surface portions facing the centrifuge chamber.

The part around the first wall of the surface portion of the one of the two facing members that define the space of the centrifuge chamber or the part around the second wall of the surface portion of the other one of the two facing members that define the space of the centrifuge chamber may be formed of an inclined plane, the surface portions facing the centrifuge chamber.

The surface portion of the one of the two facing members that define the space of the centrifuge chamber may be formed of an inclined plane extending from a circumferential edge of the first wall to an outer periphery of the centrifuge chamber, while the surface portion of the other one of the two facing members that define the space of the centrifuge chamber may be formed of an inclined plane extending from a circumferential edge of the second wall to an outer periphery of the centrifuge chamber, the surface portions facing the centrifuge chamber. The surface portion of the one of the two facing members that define the space of the centrifuge chamber may be formed of an inclined plane extending from a circumferential edge of the first wall to an outer periphery of the centrifuge chamber, or the surface portion of the other one of the two facing members that define the space of the centrifuge chamber may be formed of an inclined plane extending from a circumferential edge of the second wall to an outer periphery of the centrifuge chamber, the surface portions facing the centrifuge chamber.

A plurality of guide vanes may be provided along an outer periphery of the centrifuge chamber, each of the guide vanes may have a given angle with respect to a tangent direction of the outer periphery of the centrifuge chamber, and the guide vanes may be arranged at regular intervals in a circumferential direction of the centrifuge chamber.

The inclined plane may be inclined such that the height of the centrifuge chamber increases from the outer periphery toward the center thereof. Gas to be supplied to the powder classifying apparatus may be selected in accordance with an intended application, and an example thereof is air.

In the present invention, the inclined plane does not have to have a linear sectional shape but may have a curved sectional shape curved such that the height of the centrifuge chamber increases from the outer periphery toward the center thereof. In addition, the inclined plane may have a sectional shape in which a line and a curve are combined.

Advantageous Effects of Invention

According to the present invention, the classification point of a powder classifying apparatus can be smaller as compared to that of the conventional art while high accuracy is maintained in classification of raw material powder having a particle size distribution into fine powder and coarse powder.

DESCRIPTION OF EMBODIMENTS

A powder classifying apparatus of the present invention will be now described in detail based on a preferred embodiment illustrated in the attached drawings.

Figure 1:
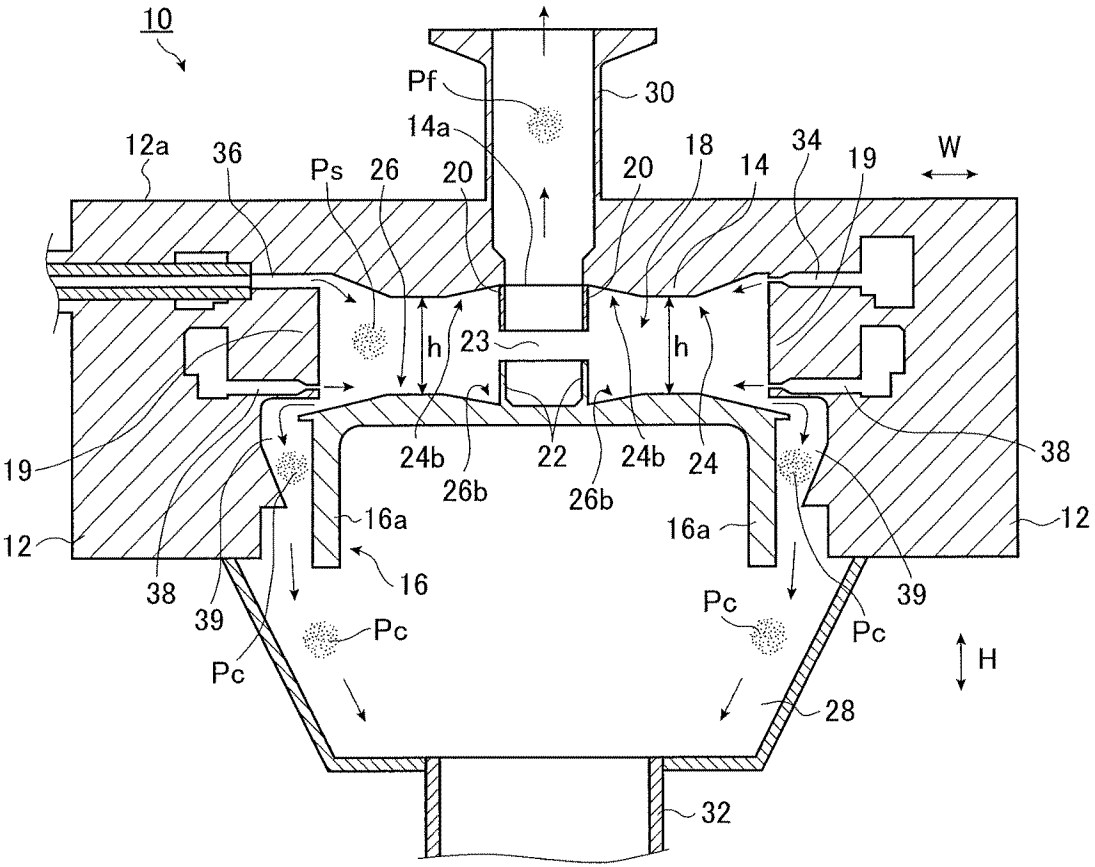
FIG. 1 is a cross-sectional view schematically showing a powder classifying apparatus according to an embodiment of the present invention.
Figure 2:
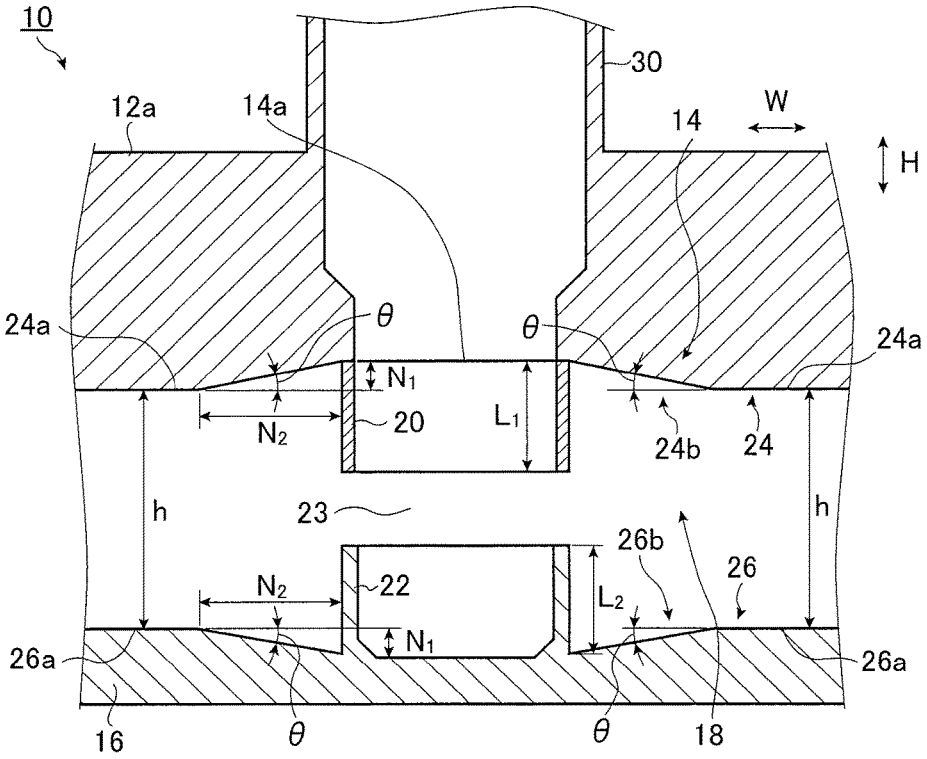
FIG. 2 is an enlarged view showing a main part of the powder classifying apparatus shown in FIG. 1.

FIG. 1 is a cross-sectional view schematically showing the powder classifying apparatus according to an embodiment of the present invention. FIG. 2 is an enlarged view showing a main part of the powder classifying apparatus shown in FIG. 1.

A powder classifying apparatus 10 shown in FIG. 1 includes a cylindrical casing 12. Inside the casing 12, a circular upper disk-like member 14 is provided. A lower disk-like member 16 having a substantially circular outer shape is arranged so as to face the upper disk-like member 14 with a given interval.

A substantially disk-shaped centrifuge chamber 18 is defined by and formed between the upper disk-like member 14 and the lower disk-like member 16, and an outer periphery in a circumferential direction of the centrifuge chamber 18 is closed by an annular section 19 of the casing 12. As described above, the centrifuge chamber 18 is a space between the upper disk-like member 14 and the lower disk-like member 16 facing each other. The upper disk-like member 14 and the lower disk-like member 16 are members defining the space of the centrifuge chamber 18.

A cylindrical opening portion 14*a* is formed in a central portion of the upper disk-like member 14 and communicates with the centrifuge chamber 18. A first wall 20 in a cylindrical shape is disposed along the edge of the opening portion 14*a* of the upper disk-like member 14 and projects into the centrifuge chamber 18. A second wall 22 in a cylindrical shape is disposed on the lower disk-like member 16 so as to face the first wall 20 with a given interval to generate a gap 23. The first wall 20 and the second wall 22 are arranged in a central portion of the centrifuge chamber 18 in a direction W, which is a direction perpendicular to a direction H.

A fine powder collecting tube 30 is disposed on the opening portion 14*a* so as to extend in the direction H that is perpendicular to a surface 12*a* of the casing 12. The fine powder collecting tube 30 discharges an air stream including fine powder Pf separated in the centrifuge chamber 18 to the outside of the centrifuge chamber 18 through the gap 23, and is connected to a suction blower (not shown) via a fine powder collecting device such as a bag filter (not shown).

An edge of the lower disk-like member 16 is bent, and there is a gap 39 between a bent section 16*a* and the casing 12. The gap 39 is positioned at an outer peripheral portion of the centrifuge chamber 18. A coarse powder collecting chamber 28 in a hollow truncated cone shape is provided under the casing 12. The centrifuge chamber 18 and the coarse powder collecting chamber 28 communicate with each other via the gap 39.

The coarse powder collecting chamber 28 discharges coarse powder Pc separated in the centrifuge chamber 18 to the outside of the centrifuge chamber 18. A coarse powder collecting tube 32 for collecting the separated coarse powder is provided to the coarse powder collecting chamber 28. At the lower end of the coarse powder collecting tube 32, a hopper (not shown) is provided via a rotary valve (not shown). The coarse powder Pc separated in the centrifuge chamber 18 passes through the gap 39, the coarse powder collecting chamber 28 and the coarse powder collecting tube 32 and is collected in the hopper.

The annular section 19 of the casing 12 is provided with a plurality of first air nozzles 34 and a raw material ejecting nozzle 36 on a side closer to the fine powder collecting tube 30 in the direction H. The annular section 19 is also provided with second air nozzles 38 below the first air nozzles 34 in the direction H.

The plurality of, e.g., six first air nozzles 34 are disposed along the outer periphery of the centrifuge chamber 18 such that the six first air nozzles 34 are arranged at regular intervals in a circumferential direction of the centrifuge chamber 18 while each of the first air nozzles 34 forms a given angle with respect to a tangential direction of the outer periphery of the centrifuge chamber 18. The raw material ejecting nozzle 38 is disposed in the vicinity of one of the first air nozzles 34.

Although not illustrated in detail, similarly to the first air nozzles 34, the plurality of, e.g., six second air nozzles 38 are also disposed along the outer periphery of the centrifuge chamber 18 such that the six second air nozzles 38 are arranged at regular intervals in a circumferential direction of the centrifuge chamber 18 while each of the second air nozzles 38 forms a given angle with respect to a tangential direction of the outer periphery of the centrifuge chamber 18.

The first air nozzles 34 and the second air nozzles 38 are connected to a pressurized gas supply section (not shown). The pressurized gas supply section supplies gas at a predetermined pressure to the first air nozzles 34 and the second air nozzles 38, and each of the first air nozzles 34 and second air nozzles 38 ejects the pressurized gas, whereby a whirling stream whirling in the same direction is formed in the centrifuge chamber 18. The gas is appropriately selected depending on the raw material powder to be classified, the application thereof and the like, and air may be used in an exemplary case. If the raw material powder is reactive with air, another gas that is unreactive may be appropriately used.

The raw material ejecting nozzle 36 is connected to a raw material supply section (not shown) via a pipe (not shown). A given amount of raw material powder Ps is supplied to the raw material ejecting nozzle 36 and to the centrifuge chamber 18 with an air stream.

The respective numbers of the first air nozzles 34, the second air nozzles 38 and the raw material ejecting nozzle 36 are not particularly limited to those described above; the numbers may be one or two or more and are appropriately selected depending on, for example, a configuration of the apparatus.

In addition, the second air nozzles 38 are not particularly limited to nozzles; they may be conventional guide vanes or the like, which may be selected depending on a configuration of the apparatus.

Next, the centrifuge chamber 18 is described with reference to FIGS. 1 and 2.

As described above, the upper surface and the lower surface of the centrifuge chamber 18 are constituted of the upper disk-like member 14 and the lower disk-like member 16, respectively. In the centrifuge chamber 18, a height h measured parallel to the direction H is not constant from the outer periphery toward the center in the direction W. The height is large near the first air nozzles 34, the raw material ejecting nozzle 36 and the second air nozzles 38, decreases toward the center, stays constant in a certain region and gradually increases toward the center.

In this case, as illustrated in FIG. 2, a surface portion 24, facing the centrifuge chamber 18, of the upper disk-like member 14 is provided with a flat part 24*a* and an inclined part 24*b* that is continuous with the flat part 24*a* and that is formed adjacent to the first wall 20 in a cylindrical shape. A surface portion 26, facing the centrifuge chamber 18, of the lower disk-like member 16 is provided with a flat part 26*a* and an inclined part 26*b* that is continuous with the flat part 26*a* and that is formed adjacent to the second wall 22 in a cylindrical shape. Each of the inclined parts 24*b* and 26*b* is an inclined plane, has a linear sectional shape and is inclined such that the height of the centrifuge chamber 18 becomes larger. Each of the flat part 24*a* of the upper disk-like member 14 and the flat part 26*a* of the lower disk-like member 16 is a plane surface parallel to the direction W.

An angle of the inclined part 24*b* with respect to the flat part 24*a* of the upper disk-like member 14 and an angle of the inclined part 26*b* with respect to the flat part 26*a* of the lower disk-like member 16 are each represented by θ. The angle θ is preferably 5° to 30°, and more preferably 10° to 20°. When the angle θ is 5° to 30°, the classification point for classifying the raw material powder Ps into the fine powder Pf and the coarse powder Pc can be small.

The angle θ of the inclined part 24*b* with respect to the flat part 24*a* of the upper disk-like member 14 and the angle θ of the inclined part 26*b* with respect to the flat part 26*a* of the lower disk-like member 16 may be the same or different from each other.

In the conventional art, the inclined parts 24*b* and 26*b* of the powder classifying apparatus 10 are not provided, and the height of the classifying chamber 18 is larger near the first air nozzles 34, the raw material ejecting nozzle 36 and the second air nozzles 38, decreases toward the center and, at a certain point, becomes constant to stay in the same height up to the center of the centrifuge chamber 18.

While the angle θ of each of the inclined part 24*b* of the upper disk-like member 14 and the inclined part 26*b* of the lower disk-like member 16 is defined, the inclined parts 24*b* and 26*b* are not necessarily defined in this manner. The inclined parts 24*b* and 26*b* may be defined in terms of a length $N_1$ in the direction H and a length $N_2$ in the direction W, for example.

While the inclined parts 24*b* and 26*b* each have a linear sectional shape as described above, their sectional shapes are not necessarily linear. The inclined parts 24*b* and 26*b* may be formed of curved surfaces curved such that the height of the centrifuge chamber 18 becomes larger from the outer periphery toward the center of the centrifuge chamber 18 and may each have a curved sectional shape. In addition, the inclined parts 24*b* and 26*b* may be each configured as a combination of a flat surface and a curved surface, and in this case have a sectional shape in which a line and a curve are combined.

In the powder classifying apparatus 10, since the surface portion 24 of the upper disk-like member 14 is provided with the flat part 24*a* and the inclined part 24*b* that is continuous with the flat part 24*a* , while the surface portion 26, facing the centrifuge chamber 18, of the lower disk-like member 16 is provided with the flat part 26*a* and the inclined part 26*b* that is continuous with the flat part 26*a* , a width of the gap 23 in the direction H between the first wall 20 and the second wall 22 can be prevented from narrowing, and the length $L_1$ of the first wall 20 (see FIG. 2) and the length $L_2$ of the second wall 22 (see FIG. 2) can be long. Moreover, since the inclined parts 24*b* and 26*b* are provided, the fine powder Pf with a smaller particle size can be suctioned and discharged from the fine powder collecting tube 30 through the gap 23.

Next, the operation of the powder classifying apparatus 10 is described below.

First, air is sucked out from the centrifuge chamber 18 by a suction blower (not shown) through the fine powder collecting tube 30 at a given airflow rate, while pressurized gas is supplied from a pressurized gas supply section (not shown) to the six first air nozzles 34 and the six second air nozzles 38, whereby a whirling stream is generated in the centrifuge chamber 18.

In this state, a given amount of the raw material powder Ps having a particle size distribution is supplied to the raw material ejecting nozzle 36 with an air stream. Accordingly, the raw material powder Ps is supplied from the raw material ejecting nozzle 36 into the centrifuge chamber 18 at a given flow rate.

Since a whirling stream is formed inside the centrifuge chamber 18 as a result of ejection of the pressurized gas from the first air nozzles 34 and the second air nozzles 38, the raw material powder Ps supplied from the raw material ejecting nozzle 36 to the centrifuge chamber 18 is whirled and centrifuged in the centrifuge chamber 18. Accordingly, the coarse powder Pc having a large particle size does not flow into the fine powder collecting tube 30 but remains in the centrifuge chamber 18 owing to the cylindrical first wall 20 and second wall 22 formed at the central portion of the centrifuge chamber 18, whereas the fine powder Pf having a particle size smaller than the classification point is sucked out and discharged through the fine powder collecting tube 30 via the gap 23 with an airflow.

The fine powder Pf can be separated from the raw material powder Ps having a particle size distribution and collected in this manner. In addition, as described above, owing to the inclined parts 24*b* and 26*b* , the first wall 20 (see FIG. 2) and the second wall 22 (see FIG. 2) can have the long lengths $L_1$ and $L_2$, respectively, whereby the particle size of the fine powder Pf to be collected can be small.

Meanwhile, the remainder of the raw material powder that has not been discharged through the fine powder collecting tube 30, that is, the coarse powder Pc falls from the centrifuge chamber 18 to the coarse powder collecting chamber 28 as passing through the gap 39 between the lower disk-like member 16 and the annular section 19. Thereafter, the remainder of the raw material powder, that is, the coarse powder Pc is collected through the coarse powder collecting tube 32.

Depending on the condition such as the state of the air stream, the use of guide vanes in place of the air nozzles may achieve highly accurate classification.

Accordingly, the use of the conventional guide vanes may be selected in accordance with the intended classification.

In the powder classifying apparatus 10, since the outer peripheral portion in the circumferential direction of the centrifuge chamber 18 in a substantially disk-like shape is closed by the annular section 19, even if a large amount of pressurized gas is forcibly introduced in the centrifuge chamber 18 through the first air nozzles 34 and the second air nozzles 38, air does not leak out from the centrifuge chamber 18 outward in the circumferential direction, and the whirl is not disturbed. Accordingly, submicron particles can stably undergo classification when, in particular, a flow rate of pressurized gas introduced through the first air nozzles 34 for forming a whirling stream in the coarse powder collecting chamber 28 is increased.

While fine particles such as submicron particles tend to agglomerate together, the powder classifying apparatus 10 can perform efficient classification of such particles by ejecting a large amount of pressurized gas from the first air nozzles 34 and the second air nozzles 38. In addition, various kinds of powder including from those having a low-specific gravity such as silica and toner to those having a high-specific gravity such as metals and alumina can be used as the raw material powder to be classified.

In the meantime, depending on the intended classification, the second air nozzles 38 may be replaced with guide vanes that allow more flexible setting of the airflow rate.

While the cylindrical first wall 20 and second wall 22 are disposed so as to face each other with the gap 23 there between in the powder classifying apparatus 10, only one of the first wall 20 and second wall 22 may be provided.

Figure 3A:
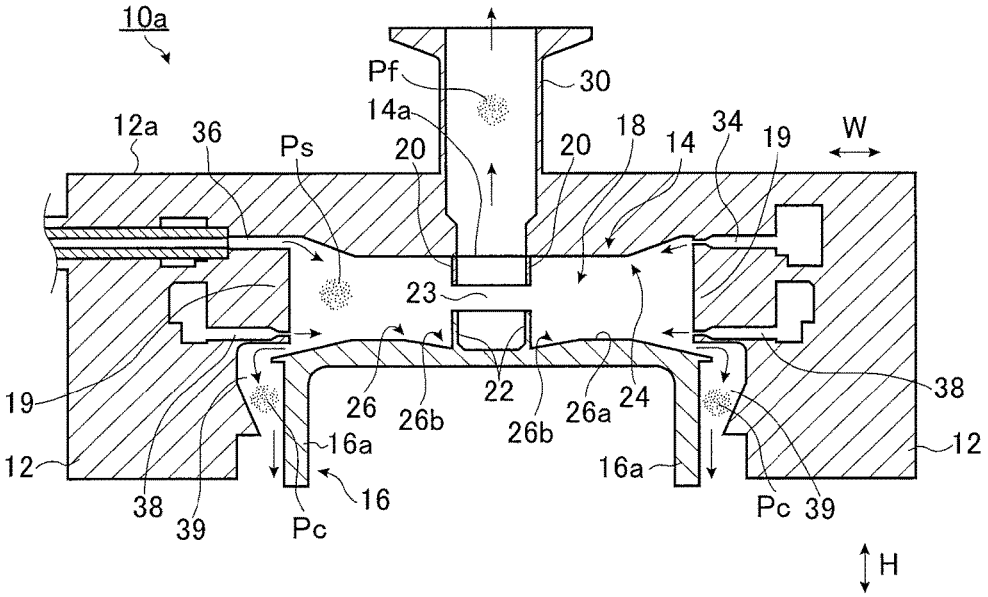
FIG. 3A is a cross-sectional view schematically showing a first variation of the powder classifying apparatus according to the embodiment of the present invention.
Figure 3B:
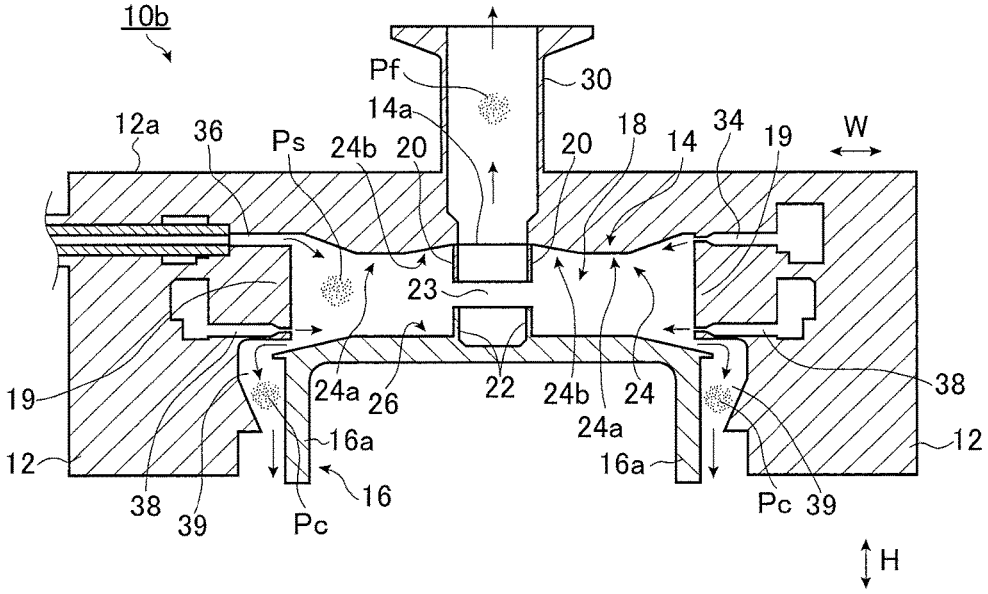
FIG. 3B is a cross-sectional view schematically showing a second variation of the powder classifying apparatus according to the embodiment of the present invention.
Figure 4:
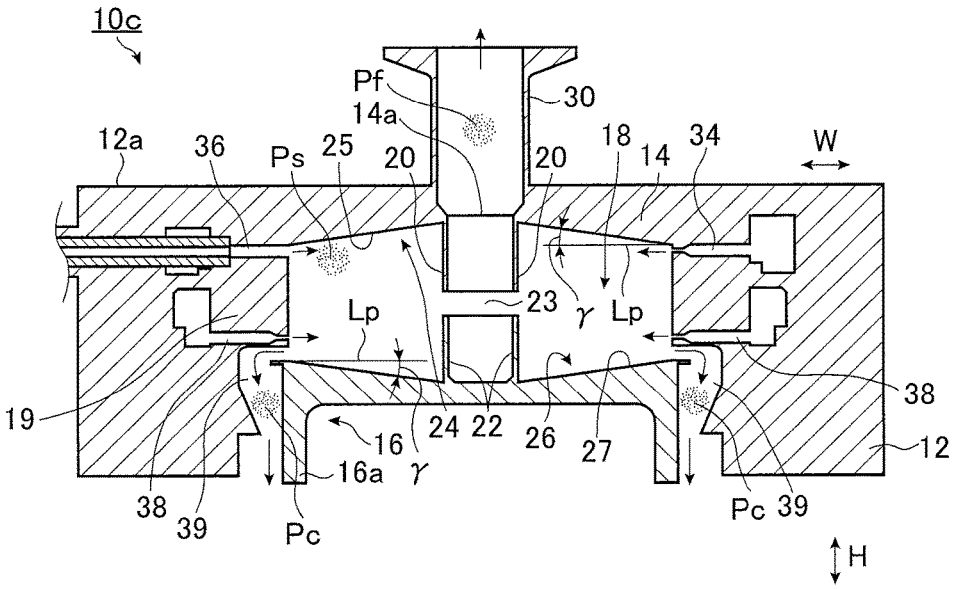
FIG. 4 is a cross-sectional view schematically showing a third variation of the powder classifying apparatus according to the embodiment of the present invention.
Figure 5:
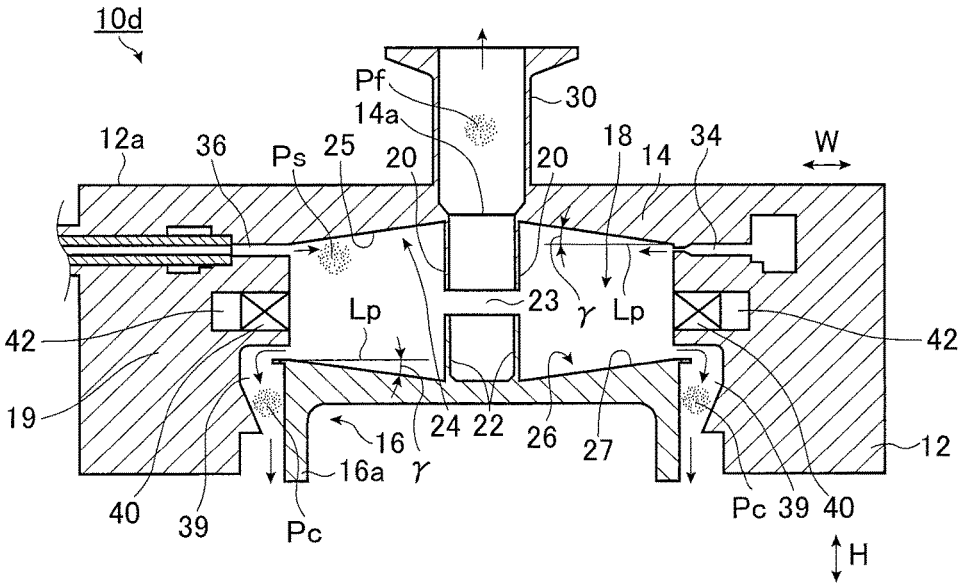
FIG. 5 is a cross-sectional view schematically showing a fourth variation of the powder classifying apparatus according to the embodiment of the present invention.

The configuration of the powder classifying apparatus 10 is not particularly limited to the one as described above, and a configuration of a powder classifying apparatus 10*a* shown in FIG. 3A, a powder classifying apparatus 10*b* shown in FIG. 3B, a powder classifying apparatus 10*c* shown in FIG. 4 or a powder classifying apparatus 10*d* shown in FIG. 5 may be adopted.

FIG. 3A illustrates a cross-sectional view schematically showing a first variation of the powder classifying apparatus according to the embodiment of the present invention, and FIG. 3B illustrates a cross-sectional view schematically showing a second variation of the powder classifying apparatus according to the embodiment of the present invention. FIG. 4 illustrates a cross-sectional view schematically showing a third variation of the powder classifying apparatus according to the embodiment of the present invention. FIG. 5 illustrates a cross-sectional view schematically showing a fourth variation of the powder classifying apparatus according to the embodiment of the present invention. In each of FIGS. 3A, 3B, 4 and 5, the raw material supply section, the pipes, the coarse powder collecting chamber 28 and the coarse powder collecting tube 32 and others are omitted.

In the powder classifying apparatus 10*a* shown in FIG. 3A, the powder classifying apparatus 10*b* shown in FIG. 3B and the powder classifying apparatus 10*c* shown in FIG. 4, the same constitutional elements as those in the powder classifying apparatus 10 shown in FIG. 1 are assigned with the same reference signs, the detailed description of which are omitted.

As compared to the powder classifying apparatus 10 shown in FIG. 1, the powder classifying apparatus 10*a* shown in FIG. 3A is different in that the inclined part 24*b* is not provided in the surface portion 24 of the upper disk-like member 14 but the surface portion 24 is flat also near the first wall 20 in the centrifuge chamber 18; except this difference, the powder classifying apparatus 10*a* is configured to be the same as the powder classifying apparatus 10 shown in FIG. 1.

The powder classifying apparatus 10*a* shown in FIG. 3A can classify the raw material powder in the similar manner to that of the powder classifying apparatus 10 shown in FIG. 1. Accordingly, the detailed description of the classification method thereof is omitted. The powder classifying apparatus 10*a* can also classify the raw material powder with the smaller classification point than the conventional classification point with high accuracy and stability similarly to the powder classifying apparatus 10 shown in FIG. 1.

As compared to the powder classifying apparatus 10 shown in FIG. 1, the powder classifying apparatus 10*b* shown in FIG. 3B is different in that the inclined part 26*b* is not provided in the surface portion 26 of the lower disk-like member 16 but the surface portion 26 is flat also near the second wall 22 in the centrifuge chamber 18; except this difference, the powder classifying apparatus 10*b* is configured to be the same as the powder classifying apparatus 10 shown in FIG. 1.

The powder classifying apparatus 10*b* shown in FIG. 3B can classify the raw material powder in the similar manner to that of the powder classifying apparatus 10 shown in FIG. 1. Accordingly, the detailed description of the classification method thereof is omitted. The powder classifying apparatus 10*b* can also classify the raw material powder with the smaller classification point than the conventional classification point with high accuracy and stability similarly to the powder classifying apparatus 10 shown in FIG. 1.

As compared to the powder classifying apparatus 10 shown in FIG. 1, the powder classifying apparatus 10*c* shown in FIG. 4 is different in that the surface portion 24 of the upper disk-like member 14 is constituted of an inclined plane 25 extending from the circumferential edge of the first wall 20 and reaching the outer periphery of the upper disk-like member 14, and the surface portion 26 of the lower disk-like member 16 is constituted of an inclined plane 27 extending from the circumferential edge of the second wall 22 and reaching the outer periphery of the lower disk-like member 16; except this difference, the powder classifying apparatus 10*c* is configured to be the same as the powder classifying apparatus 10 shown in FIG. 1.

In the powder classifying apparatus 10*c* shown in FIG. 4, each of the inclined planes 25 and 27 has a linear sectional shape and is inclined such that the height of the centrifuge chamber 18 increases from the outer periphery toward the center thereof, i.e., from the annular section 19 toward the gap 23.

The angle γ of each of the inclined planes 25 and 27 is defined as an angle formed between a line Lp parallel to the direction W and the inclined plane 25 or 27. The angle γ is the same as the angle θ in the powder classifying apparatus 10 shown in FIG. 2 and is preferably 5° to 30°, and more preferably 10° to 20°.

While the inclined planes 25 and 27 have linear sectional shapes, they do not have to have linear sectional shapes but may have curved sectional shapes curved such that the height of the centrifuge chamber 18 increases from the outer periphery toward the center thereof. In addition, each of the inclined planes 25 and 27 may have a sectional shape in which a line and a curve are combined.

The powder classifying apparatus 10*c* shown in FIG. 4 can classify the raw material powder in the similar manner to that of the powder classifying apparatus 10 shown in FIG. 1. Accordingly, the detailed description of the classification method thereof is omitted. The powder classifying apparatus 10*c* can also classify the raw material powder with the smaller classification point than the conventional classification point with high accuracy and stability similarly to the powder classifying apparatus 10 shown in FIG. 1.

While in the powder classifying apparatus 10*c* shown in FIG. 4, the surface portion 24 of the upper disk-like member 14 and the surface portion 26 of the lower disk-like member 16 are constituted of the inclined planes 25 and 27, respectively, this is not the sole case, and at least one of the surface portion 24 of the upper disk-like member 14 and the surface portion 26 of the lower disk-like member 16 may be formed of an inclined plane.

As compared to the powder classifying apparatus 10*c* shown in FIG. 4, the powder classifying apparatus 10*d* shown in FIG. 5 is different in that guide vanes 40 are provided in place of the second air nozzles 38; except this difference, the powder classifying apparatus 10*d* is configured to be the same as the powder classifying apparatus 10*c* shown in FIG. 4.

In the powder classifying apparatus 10*d*, the plurality of guide vanes 40 are provided along the outer periphery of the centrifuge chamber 18 in the same manner as the second air nozzles 38. In addition, the guide vanes 40 are provided to the annular section 19 and below the first air nozzles 34 in the direction H. Similarly to the first air nozzles 34, the guide vanes 40 are arranged at regular intervals in a circumferential direction of the centrifuge chamber 18 while each of the guide vanes 40 forms a given angle with respect to a tangential direction of the outer periphery of the centrifuge chamber 18.

Around the guide vanes 40, provided is a push-in chamber 42 for retaining air and supplying air into the centrifuge chamber 18. The push-in chamber 42 is connected to the pressurized gas supply section (not shown). Gas pressurized to a given pressure is supplied from the pressurized gas supply section via the push-in chamber 42 through gaps between the guide vanes 40. When pressurized gas is supplied to the first air nozzles 34 and the guide vanes 40, a whirling stream is generated in the centrifuge chamber 18.

In the powder classifying apparatus 10*d*, the raw material powder Ps is whirled, while moving downward, to be centrifuged in the centrifuge chamber 18, and the guide vanes 40 exhibit a function to adjust the whirling speed of the raw material powder Ps during centrifugation. For instance, each guide vane 40 is rotatably supported by a rotation shaft (not shown) on the annular section 19, and is engaged with a rotation plate (not shown) using a pin (not shown). For instance, the guide vanes 40 are configured such that all of the guide vanes 40 rotate by a given angle at a time when the rotation plate is rotated. The gap between the adjacent guide vanes 40 is adjusted through rotation of all of the guide vanes 40 by a given angle upon the rotation of the rotation plate, whereby the flow rate of gas, e.g., air passing through the gaps between the guide vanes 40 can be altered. The classification performance such as the classification point can be changed in this manner. In addition, provision of the guide vanes 40 allows the broader choice of the classification point.

While the guide vanes 40 are provided in place of the second air nozzles 38 in the powder classifying apparatus 10*c* shown in FIG. 4, this is not the sole case. In the powder classifying apparatus 10 shown in FIG. 1, the powder classifying apparatus 10*a* shown in FIG. 3A or the powder classifying apparatus 10*b* shown in FIG. 3B, the guide vanes 40 may be provided in place of the second air nozzles 38.

The applicant has examined classification by the powder classifying apparatus according to the present invention. In particular, the powder classifying apparatus 10 shown in FIG. 1 as described above and a powder classifying apparatus 100 shown in FIG. 6 for comparison were used to test classification of raw material powder.

Figure 6:
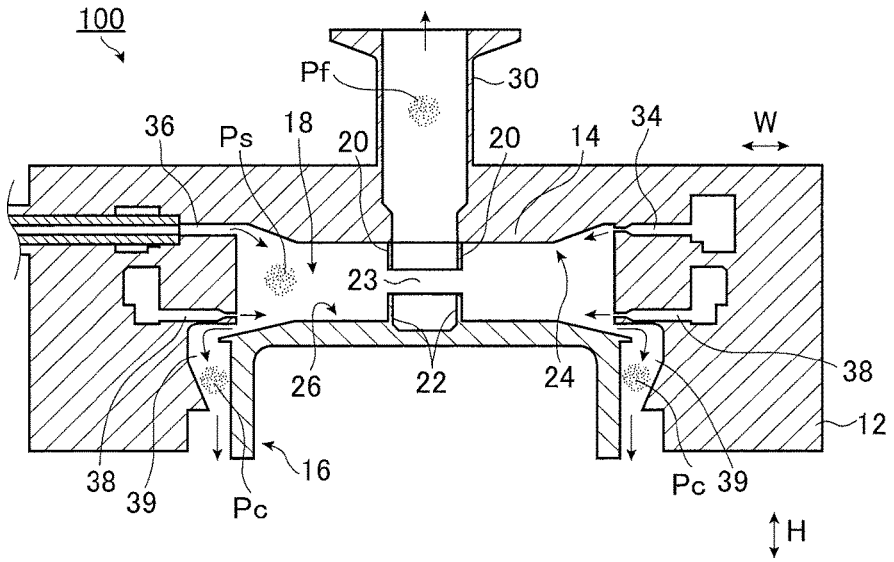
FIG. 6 is a cross-sectional view schematically showing a powder classifying apparatus for comparison.

FIG. 6 illustrates a cross-sectional view schematically showing the powder classifying apparatus for comparison. In the powder classifying apparatus 100 shown in FIG. 6, the same constitutional elements as those of the powder classifying apparatus 10 shown in FIG. 1 are assigned with the same reference signs, detailed description of which are omitted.

As compared to the powder classifying apparatus 10 shown in FIG. 1, the powder classifying apparatus 100 shown in FIG. 6 is different in that the inclined part 24*b* and the inclined part 26*b* are not provided in the surface portion 24 of the upper disk-like member 14 and in the surface portion 26 of the lower disk-like member 16, respectively; except this difference, the powder classifying apparatus 100 is configured to be the same as the powder classifying apparatus 10 shown in FIG. 1.

The powder classifying apparatus 10 of the present invention and the powder classifying apparatus 100 for comparison were operated to perform classification under the same condition including the airflow rate.

As the raw material powder, silica particles ($SiO_2$ particles) having an average particle size of 1.0 μm were used. The average particle size was measured using a laser-diffraction, scattering method.

The number of first air nozzles 34 and the number of second air nozzles 38 were each six, and the number of raw material ejecting nozzle 36 was one.

In the powder classifying apparatus 10, the inclined part 24*b* in the surface portion 24 of the upper disk-like member 14 was inclined at an angle of θ of 10°, and the inclined part 26*b* in the surface portion 26 of the lower disk-like member 16 was inclined at an angle of θ of 10°.

Figure 7:
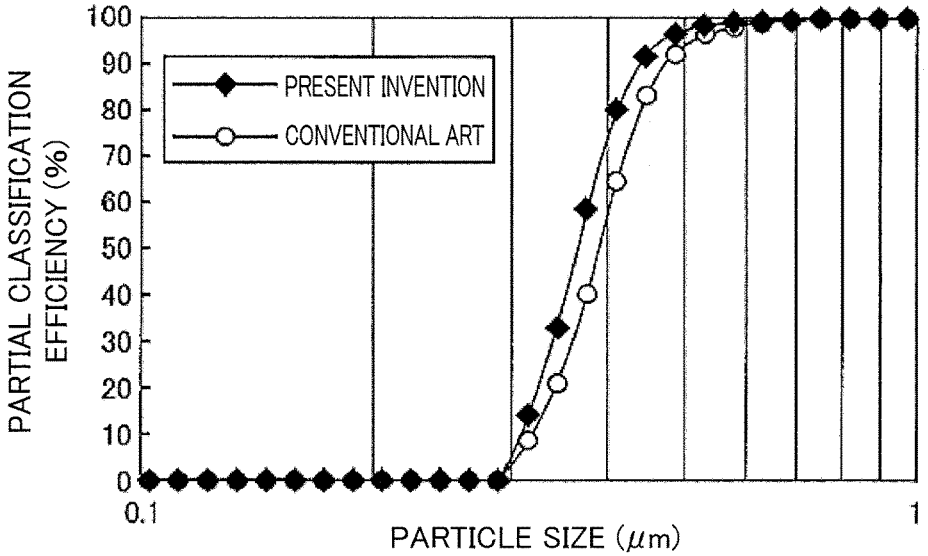
FIG. 7 is a graph showing classification efficiency of the present invention.

The measurement results of a partial classification efficiency measured by particle size are shown in FIG. 7. The sign "present invention" indicates the classification result using the powder classifying apparatus 10 (shown in FIG. 1) of the present invention, while the sign "conventional art" indicates the classification result using the conventional powder classifying apparatus 100 (shown in FIG. 6) in FIG. 7. As shown in FIG. 7, the particle size (Dp 50) at the partial classification efficiency 50% was smaller when the powder classifying apparatus 10 according to the present invention was used than when the conventional powder classifying apparatus 100 was used.

In addition, the classification accuracy (Dp 25/Dp 75) was 0.82 when the conventional powder classifying apparatus 100 was used and was 0.83 when the powder classifying apparatus 10 according to the present invention was used. Accordingly, the powder classifying apparatus 10 according to the present invention can achieve the smaller classification point while maintaining the high accuracy.

It should be noted that Dp 25 means 25% particle classification efficiency, while Dp 75 means 75% partial classification efficiency.

The present invention is basically constituted as described above. While the powder classifying apparatus according to the present invention has been described in detail, the present invention is by no means limited to the foregoing embodiment and it should be understood that various improvements and modifications may be made without departing from the scope of the invention.

REFERENCE SIGNS LIST

10, 10*a* , 10*b* , 10*c* , 10*d* , 100 powder classifying apparatus
12 casing
14 upper disc-like member
16 lower disc-like member
18 centrifuge chamber
19 annular section
20 first wall
22 second wall
24, 26 surface portion
24*a* , 26*a* flat part
24*b* , 26*b* inclined part
28 coarse powder collecting chamber
30 fine powder collecting tube
32 coarse powder collecting tube
34 first air nozzle
36 raw material ejecting nozzle
38 second air nozzle
39 gap
40 guide vane

The invention claimed is:

1. A powder classifying apparatus for classifying raw material powder having a particle size distribution into fine powder and coarse powder, comprising:

a centrifuge chamber in a disk shape formed as a space between two facing members;

a plurality of air nozzles for supplying gas into the centrifuge chamber to generate a whirling stream;

a raw material ejecting nozzle for supplying the raw material powder to the whirling stream generated in the centrifuge chamber;

a fine powder collecting tube disposed in a central portion of one of the two facing members, which define the centrifuge chamber, so as to communicate with an inside of the centrifuge chamber and to discharge the gas including the fine powder that is separated through classification in the centrifuge chamber to an outside of the centrifuge chamber;

a coarse powder collecting section disposed at an outer peripheral portion of the centrifuge chamber so as to communicate with the inside of the centrifuge chamber and to discharge the coarse powder that is separated through classification in the centrifuge chamber to the outside of the centrifuge chamber;

a first wall in a cylindrical shape disposed at an opening portion of the centrifuge chamber so as to project into the centrifuge chamber, the opening portion being formed of the fine powder collecting tube; and a second wall in a cylindrical shape disposed on the other one of the two facing members, which define the centrifuge chamber, so as to face the first wall with a given interval, wherein the first wall and the second wall are projected into the centrifuge chamber so as to extend on a same line, wherein at least one of a part, surrounding a circumferential edge of the first wall, of a surface portion of the one of the two facing members that define the space of the centrifuge chamber and a part, surrounding a circumferential edge of the second wall, of a surface portion of the other one of the two facing members that define the space of the centrifuge chamber is formed of an inclined plane extending from the circumferential edge of the first wall or a second wall, the surface portions facing the centrifuge chamber, and wherein the inclined plane is inclined such that a height of the centrifuge chamber increases from an outer periphery toward a center of the centrifuge chamber.

2. The powder classifying apparatus according to claim 1, wherein the circumferential edge of the first wall of the surface portion of the one of the two facing members that define the space of the centrifuge chamber is formed of the inclined plane, while the circumferential edge of the second wall of the surface portion of the other one of the two facing members that define the space of the centrifuge chamber is formed of the inclined plane, the surface portions facing the centrifuge chamber.

3. The powder classifying apparatus according to claim 1, wherein the circumferential edge of the first wall of the surface portion of the one of the two facing members that define the space of the centrifuge chamber or the circumferential edge of the second wall of the surface portion of the other one of the two facing members that define the space of the centrifuge chamber is formed of the inclined plane, the surface portions facing the centrifuge chamber.

4. The powder classifying apparatus according to claim 1, wherein the surface portion of the one of the two facing members that define the space of the centrifuge chamber is formed of the inclined plane extending from a circumferential edge of the first wall to an outer periphery of the centrifuge chamber, while the surface portion of the other one of the two facing members that define the space of the centrifuge chamber is formed of the inclined plane extending from a circumferential edge of the second wall to an outer periphery of the centrifuge chamber, the surface portions facing the centrifuge chamber.

5. The powder classifying apparatus according to claim 1, wherein the surface portion of the one of the two facing members that define the space of the centrifuge chamber is formed of the inclined plane extending from a circumferential edge of the first wall to an outer periphery of the centrifuge chamber, or the surface portion of the other one of the two facing members that define the space of the centrifuge chamber is formed of the inclined plane extending from a circumferential edge of the second wall to an outer periphery of the centrifuge chamber, the surface portions facing the centrifuge chamber.

6. The powder classifying apparatus according to claim 1, wherein a plurality of guide vanes are provided along an outer periphery of the centrifuge chamber, each of the guide vanes has a given angle with respect to a tangent direction of the outer periphery of the centrifuge chamber, and the guide vanes are arranged at regular intervals in a circumferential direction of the centrifuge chamber.

7. The powder classifying apparatus according to claim 2, wherein a plurality of guide vanes are provided along an outer periphery of the centrifuge chamber, each of the guide vanes has a given angle with respect to a tangent direction of the outer periphery of the centrifuge chamber, and the guide vanes are arranged at regular intervals in a circumferential direction of the centrifuge chamber.

8. The powder classifying apparatus according to claim 3, wherein a plurality of guide vanes are provided along an outer periphery of the centrifuge chamber, each of the guide vanes has a given angle with respect to a tangent direction of the outer periphery of the centrifuge chamber, and the guide vanes are arranged at regular intervals in a circumferential direction of the centrifuge chamber.

9. The powder classifying apparatus according to claim 4, wherein a plurality of guide vanes are provided along an outer periphery of the centrifuge chamber, each of the guide vanes has a given angle with respect to a tangent direction of the outer periphery of the centrifuge chamber, and the guide vanes are arranged at regular intervals in a circumferential direction of the centrifuge chamber.

10. The powder classifying apparatus according to claim 5, wherein a plurality of guide vanes are provided along an outer periphery of the centrifuge chamber, each of the guide vanes has a given angle with respect to a tangent direction of the outer periphery of the centrifuge chamber, and the guide vanes are arranged at regular intervals in a circumferential direction of the centrifuge chamber.

11. The powder classifying apparatus according to claim 1, wherein the gas supplied into the centrifuge chamber is air.

12. The powder classifying apparatus according to claim 2, wherein the gas supplied into the centrifuge chamber is air.

13. The powder classifying apparatus according to claim 3, wherein the gas supplied into the centrifuge chamber is air.

14. The powder classifying apparatus according to claim 4, wherein the gas supplied into the centrifuge chamber is air.

15. The powder classifying apparatus according to claim 5, wherein the gas supplied into the centrifuge chamber is air.

16. The powder classifying apparatus according to claim 1, wherein the inclined plane has a sectional shape in which a line and a curve are combined.

17. The powder classifying apparatus according to claim 1, wherein the inclined plane has a curved sectional shape.

* * * * *